United States Patent [19]

Ruggeri

[11] 4,421,077

[45] Dec. 20, 1983

[54] VARIABLE TIMING ROTARY VALVE FOR AN INTERNAL COMBUSTION ENGINE

[76] Inventor: John R. Ruggeri, 79 Apple Valley Rd., Stamford, Conn. 06903

[21] Appl. No.: 185,971

[22] Filed: Sep. 10, 1980

Related U.S. Application Data

[63] Continuation-in-part of Ser. No. 38,280, May 11, 1979, Pat. No. 4,370,955, which is a continuation-in-part of Ser. No. 21,444, Mar. 19, 1979, abandoned.

[51] Int. Cl.[3] ..... F01L 7/18

[52] U.S. Cl. ..... 123/190 BD; 123/80 BA

[58] Field of Search ..... 123/80 R, 80 BA, 190 R, 123/190 A, 190 AA, 190 B, 190 BD

[56] References Cited

U.S. PATENT DOCUMENTS

| | | | |
|---|---|---|---|
| 1,578,581 | 3/1926 | Casna | 123/190 A |
| 3,948,227 | 4/1976 | Guenther | 123/190 B |
| 3,993,036 | 11/1976 | Tischler | 123/190 A |
| 4,201,174 | 5/1980 | Vallejos | 123/190 B |

FOREIGN PATENT DOCUMENTS

| | | | |
|---|---|---|---|
| 687716 | 10/1930 | France | 123/190 A |

*Primary Examiner*—Craig R. Feinberg
*Assistant Examiner*—W. R. Wolfe
*Attorney, Agent, or Firm*—F. Eugene Davis, IV

[57] ABSTRACT

A rotary valve with means for effecting variable timing of intake valve opening, variable opening duration and variable timing of closing in response to changes in each engine cylinder's appetite for an intake charge is disclosed. Earliest valve opening, longest duration and latest closing occur when each cylinder's appetite for an intake charge is largest, while latest opening, shortest duration and earliest closing occur when each cylinder's appetite for an intake charge is smallest.

Intake valve timing can be varied sufficiently to permit use of the theoretical Top Dead Center Opening and Bottom Dead Center Closing for idle, low speed and coasting operating modes to the typical average 20 degrees Before Top Dead Center Opening 50 degrees After Bottom Dead Center Closing for high speed-high load operating mode.

15 Claims, 13 Drawing Figures

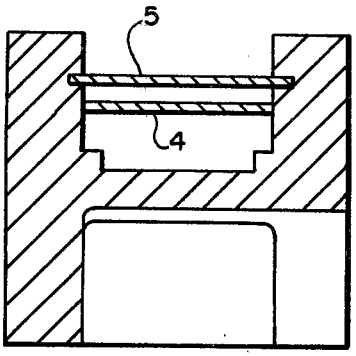
FIG. 5
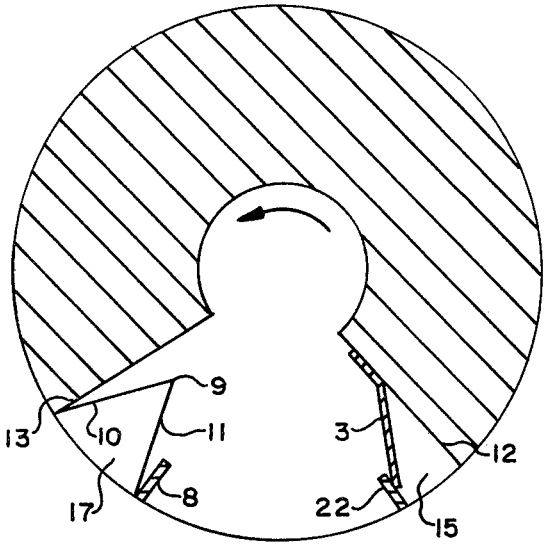
FIG. 6
FIG. 7
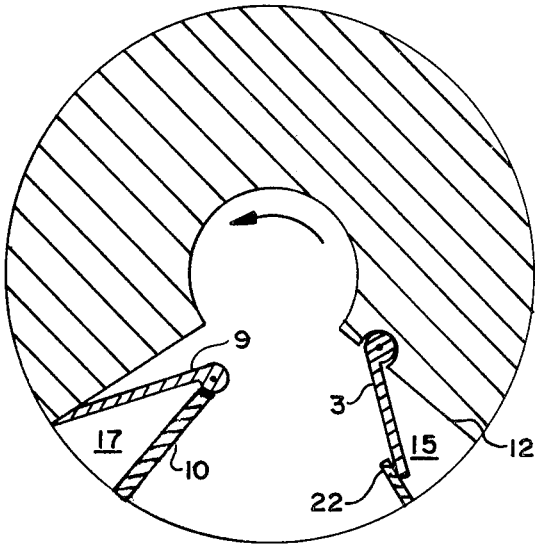

VARIABLE TIMING ROTARY VALVE FOR AN INTERNAL COMBUSTION ENGINE

RELATED APPLICATIONS

This application is a continuation-in-part of my copending application, Ser. No. 38,280, filed May 11, 1979, entitled ROTARY VALVE FOR AN INTERNAL COMBUSTION ENGINE, which application issued as Pat. No. 4,370,955, Feb. 1, 1983, and was in turn a continuation-in-part of Ser. No. 21,444, filed Mar. 19, 1979, now abandoned. Said applications are incorporated herein by reference.

BACKGROUND OF THE INVENTION

This invention relates to rotary valves for internal-combustion engines and, more particularly to apparatus to obtain variable timing of intake opening, variable intake opening duration and variable timing of intake closing of rotary valves.

The timing of the opening of the intake and exhause valves of an internal combustion engine is inflexible once established by the design of the camshaft in a conventional poppet valve engine, or by the design of the head ports and circumferential valve body openings in a typical rotary valve engine. The appetite of an engine for an intake charge, however, is quite different at high RPM and high load than it is at low speed and light load, or at idle and the effect of gas momentum at these dissimilar operating modes has a significant effect on performance, fuel economy, and emissions.

At high engine speeds and moderate to heavy loads, for example, a lengthy intake valve opening duration is required to permit efficient breathing and maximum power. Early opening of the valve [typically 10–25 degrees BTDC] increases the length of time the valve is wide open during the early part of the stroke and late closing [typically 45–65 degrees ABDC] allows the charge momentum to continue filling the cylinder even though the piston is moving upward on the compression stroke. During high load operation the exhaust gases exit the cylinder with such intensity that a relative vacuum can occur at the end of the exhaust stroke. An early intake valve opening can then be advantageous in assisting cylinder scavenging as well as in obtaining increased volumetric efficiency.

During low engine speed-light load operation the situation changes and the pressure of the exhaust gases in the cylinder exceeds the pressure in the intake manifold so that early valve opening results in exhaust gases entering the intake system, diluting the fresh mixture and reducing combustion efficiency. This is particularly significant at idle since the fuel system must compensate for this dilution with extra rich mixture which increases fuel consumption and also the probability of increased emissions.

Late closing of the intake valve at speeds and loads [including low to medium speed and light to medium loads] where charge momentum does not at least counteract the piston's upward push on the intake charge, results in already inducted intake charge being pushed back into the intake system and reduces the compression of the intake charge and the engine efficiency.

Inflexible valve timing, therefore, forces the engine designer to compromise in areas of performance, fuel economy and emissions since these areas are linked to and partially dependent on valve timing and improvements in one area usually result in deterioration in at least one of the others.

Examples of prior attempts to obtain variable valve timing are included in patents to Tischler and Guenther.

Tischler, in U.S. Pat. No. 3,993,036 describes a variable timing valve which is responsive to engine speed. It retards the time of valve closing without affecting the timing of valve opening. This design provides greater than desirable valve opening during high engine speed-light load operating modes such as coasting.

Guenther, in U.S. Pat. Nos. 3,948,227 and 4,036,184 describes externally excited, load responsive apparatus to obtain variable valve timing in valves driven at $\frac{1}{4}$ engine speed. The apparatus is not applicable to valves operating at $\frac{1}{2}$ engine speed and precludes obtaining the advantages of such designs. In addition, the timing of the described valve being dependent on throttle opening, or vacuum will provide poorer than optimum timing and valve opening duration when the engine is accelerating from low speed. Consequently, poorer performance and reduced combustion efficiency are obtained under these operating conditions as compared to an engine equipped with a valve in which the timing is dependent on the engine's appetite for an intake charge.

SUMMARY OF THE INVENTION

One object of the invention is to mitigate, or eliminate the necessity for the above described design compromises permitting the design and manufacture of a higher performace, lower emissions and lower specific fuel consumption engine than comparably sized fixed timing engines, or previously proposed variable timing engines by providing a rotary valve with means for effecting variable timing of opening, variable duration, and variable timing of closing in response to changes in each engine cylinder's appetite for an intake charge. Earliest opening, longest duration, and latest closing occur when each cylinder's appetite for an intake charge is largest, while latest opening, shortest duration and earliest closing occur when each cylinder's appetite for an intake charge is smallest. Another object is to provide said means within the body of the valve and obtain said results in rotary valves driven at $\frac{1}{2}$ engine speed or at any other ratio including $\frac{1}{4}$ engine speed.

A further object is to provide a simple internally actuated varieable timing means requiring no external excitation.

Other objects of the invention will in part be obvious and will in part appear hereinafter.

This invention comprises at least one moveable member mounted at or in proximity to either or both the leading and trailing faces of a rotary valve in such a manner that at least one unsecured and free end of each member is free to move from the closed position under the influences to be described below to increase the effective circumferential length of the valve opening permitting flow through the circumferential port segments and passages controlled by said moveable members.

In one of the preferred embodiments the moveable members are flappers made of resilient material such as spring steel and as installed exert spring pressure against their abutting members.

Opening of the valve occurs when the leading edge [in the direction of valve rotation] of the circumferential opening comes into registry with the cylinder head port. An increase in the effective circumferential length at the leading edge, results therefore, in earlier valve opening. Closing of the valve occurs when the trailing edge of the circumferential valve opening moves out of registry with the cylinder head port and consequently an increase in the effective circumferential port length at the trailing edge due to flapper movement results in a delay in valve closing.

Movement of the free end of the leading edge flapper from its at rest and closed position occurs when the flapper is in registry with the cylinder port and flapper spring pressure is overcome by vacuum in the cylinder at the port or by the pressure against the flapper from incoming charge momentum. These conditions occur when the engine cylinder's appetite for an intake charge is large. On the other hand when the pressure at the cylinder port side of the flapper is above atmospheric the engine has no appetite for an intake charge and the flapper due to its resilience returns to its installed and closed position preventing flow of exhaust gases into the intake passages. Movement of the free end of each trailing edge flapper from its installed and closed position occurs when the flapper is in registry with the cylinder port and the pressure against the flapper due to the momentum of the intake charge overcomes flapper spring pressure. This flapper movement opens a passage into the cylinder past the open flapper permitting charge momentum to assist in filling the engine cylinder when its appetite for a charge is large. When the upward movement of the piston overcomes the incoming charge momentum the already inducted charge attempts to exit from the cylinder through the head port and past the flapper controlled passages in the valve but is prevented from doing so by the flapper which is closed by the pressure of the charge. The trailing edge flappers therefore permit the cylinder to induct the required amount of charge and prevent its egress once inducted.

This ability of the valve to increase its duration of opening when the cylinder's appetite for a larger intake charge is increased permits the valve timing to be set at or close to the theoretical Top Dead Center [TDC] opening and Bottom Dead Center [BDC] closing when the flappers are in the installed and closed position. This results in improved torque, fuel consumption and emissions at low engine speeds and light load operating modes as well as reduced emissions from an engine operating in a high speed coasting mode.

The invention accordingly comprises the features of construction and arrangement of parts which will be exemplified in the constructions hereinafter set forth. The scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

Crank angle positions in both FIGS. 3 and 4 are as follows:

15 degrees Before Top Dead Center [15 degrees BTDC]

10 degrees After Top Dead Center [10 degrees ATDC]

35 degrees After Bottom Dead Center [35 degrees ABDC]

50 degrees after Bottom Dead Center [50 degrees ABDC]

Figure 2:
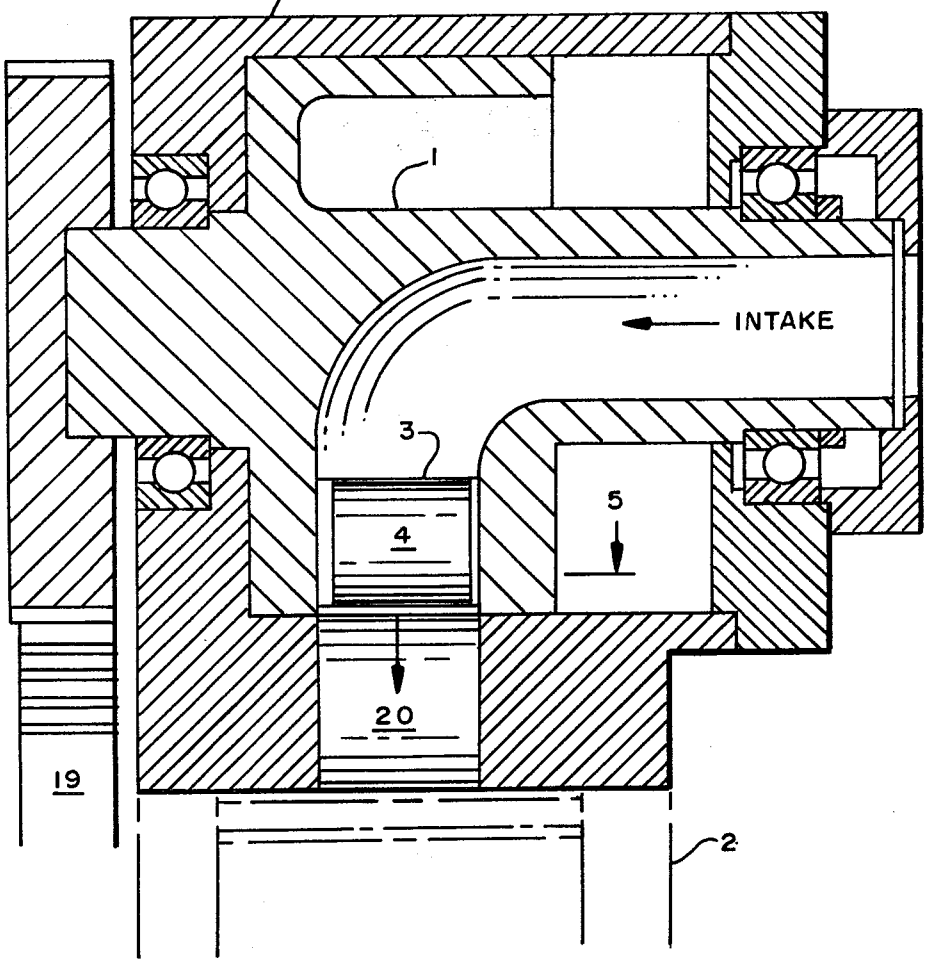
FIG. 2 is a longitudinal section through the engine and valve taken along section line 2—2 in FIG. 1.

FIG. 5 is a section taken through section line 5—5 in FIG. 2 showing flapper in closed position and mounted in a slot in the valve body.

FIG. 6 shows a chamber wall mounted flapper and its abutting member at the leading edge of the valve and a V shaped flapper in which the apex of the V is secured to the valve body at the trailing edge of the valve.

FIG. 7 shows a valve equipped with pivotally mounted flappers.

The same reference numbers refer to the same elements throughout the several views of the drawings.

DESCRIPTION OF THE PREFERRED EMBODIMENTS

Figure 1:
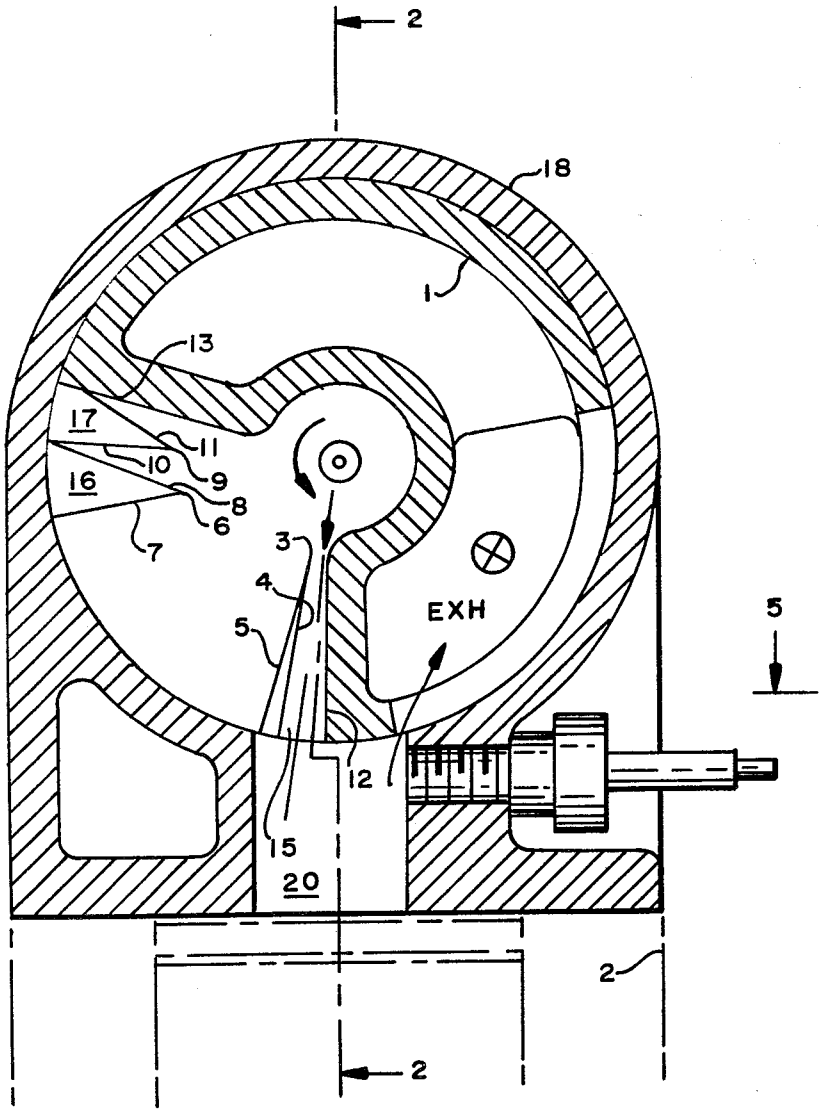
FIG. 1 is a transverse section through an engine cylinder and head, the latter serving as the rotary valve support member into which is assembled one of the preferred embodiments of the variable timing rotary valve.
Figure 3A:
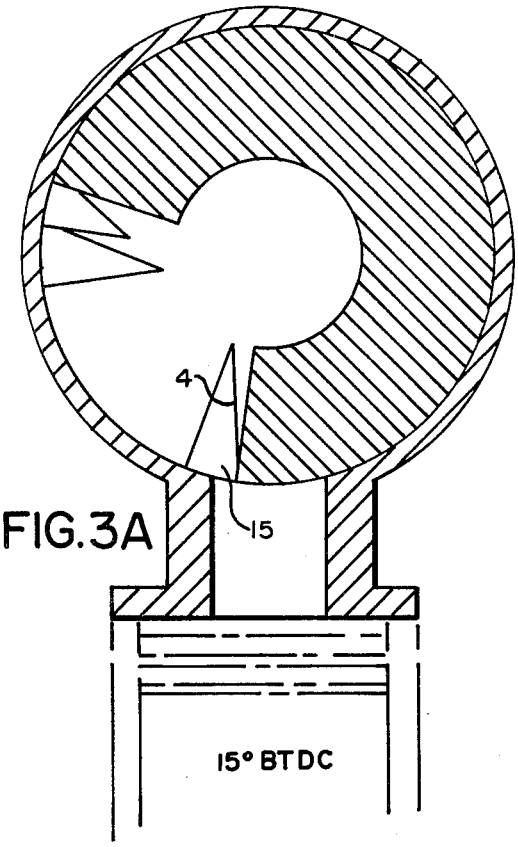
FIG. 3 is a schematic view illustrating the position of the valve and the flappers at various crank angle positions with the valve installed in an engine operating in a low speed-light load mode.
Figure 3B:
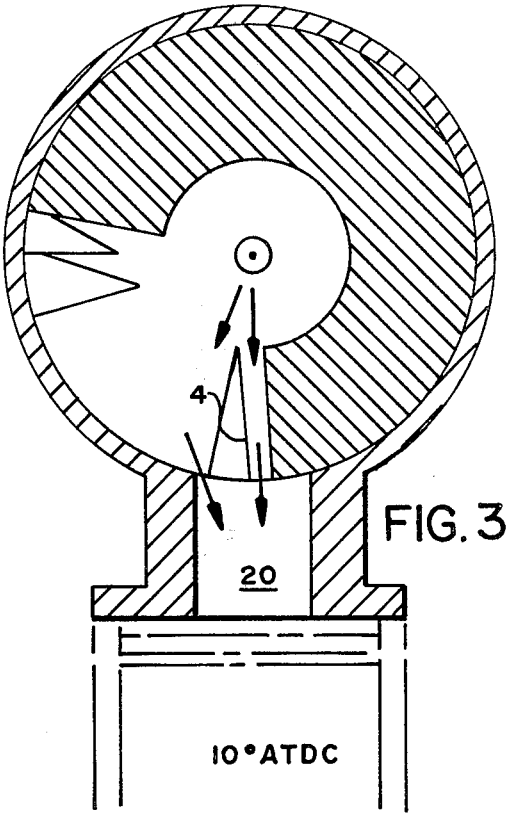
Figure 3C:
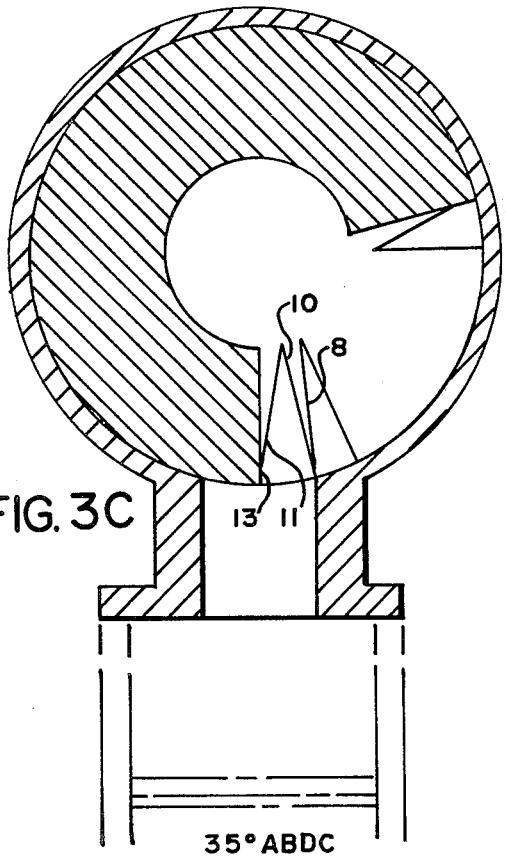
Figure 3D:
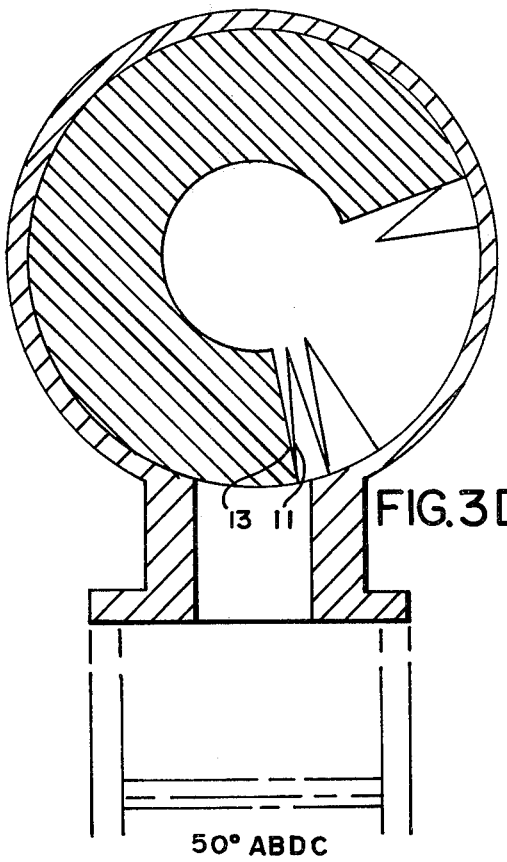
Figure 4A:
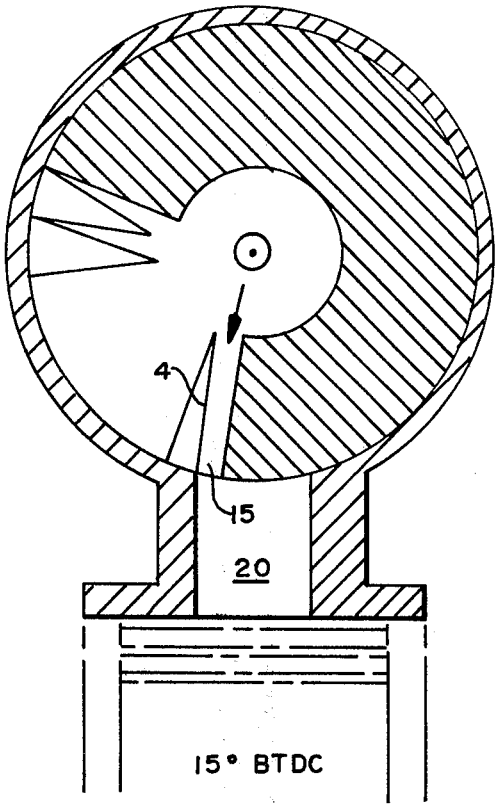
FIG. 4 is a schematic view illustrating the position of the valve and the flappers at various crank angle positions with the valve installed in an engine operating in a medium to high speed-medium load mode.
Figure 4B:
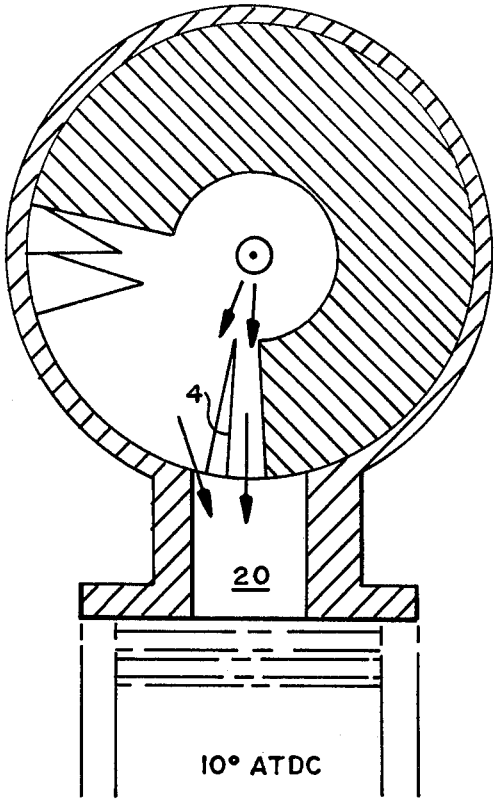
Figure 4C:
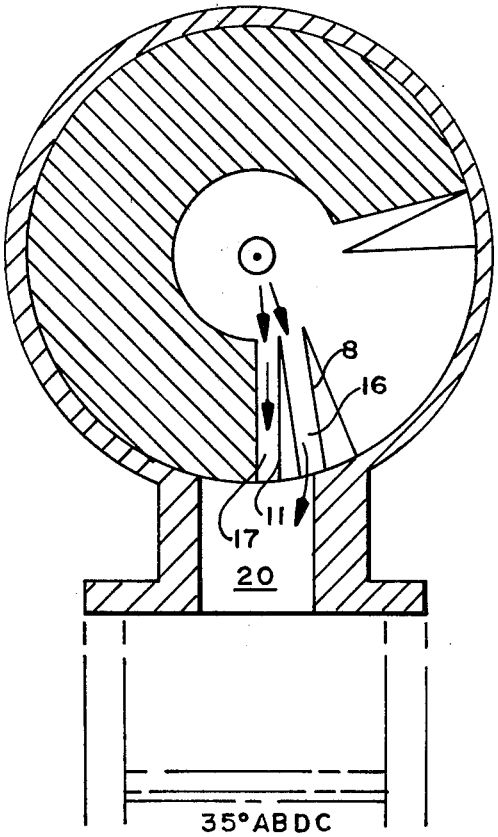
Figure 4D:
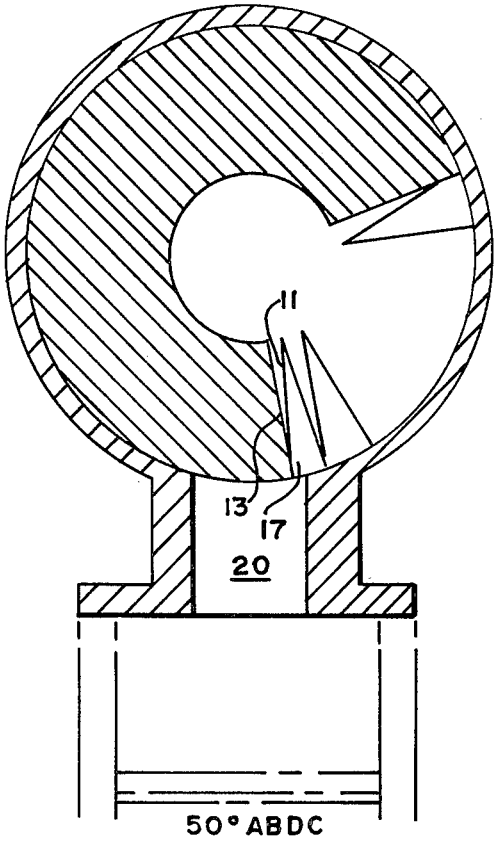

FIGS. 1 and 2 show in transverse and longitudinal section respectively a rotary valve 1 constructed in accordance with the invention, installed in cylinder head 18 which serves as the support member and cooperating with internal combustion engine 2 that is shown in diagrammatic, fragmentary outline by phantom lines.

The valve is driven at ½ engine speed by a timing belt 19 as shown in FIG. 2 to maintain a prescribed, precise angular relationship to the crankshaft. Mating gears, a chain drive or other suitable means may also be used for this purpose.

Encompassed within the valve body in the embodiment shown in FIG. 1 are three inverted V shaped flappers 3, 6, 9 made of resilient material such as spring steel. One leg 5, 7, 10 of each flapper is secured to the valve body while each of the other legs 4, 8, 11 are free to move from their installed positions. The fixed end of each flapper can be secured to the valve body in slots as shown in FIG. 5 or by other suitable methods. The free ends when in their open position form channels 15, 16, 17 in the intake chamber 18 in the body of the valve. In the drawings, the directions of flow of the intake charge and of the exhaust gases are indicated by arrowheads when in the plane of the drawing, by ⊙, which refers to the nose of the arrow, when flow direction is out of the plane of the drawing and by ⊗, which refers to the tail of the arrow, when flow direction is into the plane of the paper.

In the embodiment shown in FIGS. 1 and 2 the flappers as installed exert pressure against their abutting surfaces 10, 12, 13. When flappers are in the installed and closed position the segments of the circumferential intake port controlled by the flappers are blocked preventing flow through the blocked channels 15, 16, 17 of the valve. With flappers in the blocking position the intake valve is timed to open at Top Dead Center and to close at 10 degrees After Bottom Dead Center. This timing is not mandated by design limitations but is a logical selection from the many choices offered by the flexibility of this invention to obtain good low speed torque characteristics, low fuel consumption at part load and low emissions.

The engine shown in FIGS. 1 and 2 is equipped with a single rotary valve having exhaust chambers as well as intake chambers in a single valve body. This invention is not limited to this type of valve but can also be employed in rotary valves which contain only intake passages and chambers with separate means being employed for exhausting exhaust gases from each cylinder.

Referring to FIGS. 1 and 2, the engine is operating at high speed and load and the piston is at Top Dead Center at the end of the exhaust stroke and beginning the intake stroke. Passage 15 controlled by flapper 4 is in registry with head port 20 which also serves as the combustion chamber in this embodiment. The vacuum in the combustion chamber 20 due to the rapid egrees of exhaust gases has caused the leading edge flapper 4 to open and we have, as a result, a desirable valve overlap condition which provides good scavenging while promoting improved volumetric efficiency. At lower speeds and loads overlap is not desirable and, as explained later, is reduced by delaying the opening of the intake valve to Top Dead Center.

FIG. 3 shows, in schematic, the position of flappers in a valve installed in an engine operating in a low to medium speed, light load or idle mode at crank angle positions indicated. At 15 degrees BTDC passage 15 controlled by flapper 4 is in registry with head port 20 but vacuum, if any, due to evacuation of exhaust gases from the cylinder is inadequate to cause movement of the flapper 4 from its installed and closed position and flow through the valve is prevented. At 10 degrees ATDC the portion of the circumferential valve port not controlled by flappers has come into registry with the head port 20 and the valve is open permitting the flow of intake charge into the cylinder. In addition flapper 4 is now exposed to the vacuum resulting from the piston's downward movement and it is open, increasing the cross sectional intake charge flow area comparable to that which would be obtained with early valve opening in a conventional engine.

At 35 degrees ABDC the momentum of the intake charge is inadequate to overcome the pressure of the previously inducted intake charge attempting to leave the cylinder due to the upward motion of the piston in the cylinder. The pressure of this exiting charge forces the flappers 8 and 11 against members 10 and 13 respectively blocking flow through the valve.

At 50 degrees ABDC flapper 11 continues to be forced against member 13 preventing flow through the valve.

The timing of the opening of the valve in FIG. 3 is thus TDC and closing is at 10 degrees ABDC, which is the timing of the flapper closed valve as described above. Similar timing would be obtained from an engine installed in a vehicle operating in a coasting mode.

FIG. 4 shows the position of the flappers in a valve installed in an engine operating in a moderate speed and moderate load mode.

At 15 degrees BTDC passage 15 controlled by flapper 4 is in registry with head port 20 and the cylinder vacuum resulting from rapid evacuation of exhaust gases from the cylinder has caused the free end of flapper 4 to move from its installed position increasing the effective length of the circumferential port and opening channel 15 in the intake chamber of the valve body permitting flow of intake charge through the valve and into the combustion chamber 20. As can be seen in the illustration the circumferential port has already been in registry with the head port 20 for 5 degrees of valve rotation which corresponds to 10 degrees of crankshaft rotation. The timing of intake valve opening for this operating mode was thus between 15 degrees and 25 degrees BTDC depending on when cylinder vacuum overcame the spring pressure of flapper 4 and opened it.

At 10 degrees ATDC the flapper 4 remains in its open position due to charge momentum and cylinder vacuum thus maximizing the flow area of the circumferential port.

At 35 degrees ABDC the momentum of the intake charge developed earlier during the intake stroke is still sufficient to overcome charge pressure caused by the upward motion of the piston and flappers 8 and 11 remain open permitting a continuation of cylinder filling through passages 16 and 17.

At 50 degrees ABDC the momentum of the intake charge is inadequate to overcome the pressure of the previously inducted intake charge attempting to leave the cylinder due to the upward motion of the piston. The pressure of the exiting charge has forced the flapper 11 against the stationary member 13 blocking flow through passage 17 and therefore flow through the valve is blocked.

The timing of intake valve closing occurred, therefore, between 35 degrees ABDC and 50 degrees ABDC when the pressure of the previously inducted charge on flappers 8 or 11 caused by the upward motion of the piston forced the flappers to their closed position blocking further flow through the valve passages controlled by these flappers.

At higher engine speeds and loads the momentum of the intake charge could keep flapper 11 open until the circumferential segment of the passage 17 it controls moves out of registry with port 20. In the arrangement illustrated in FIG. 4, this occurs at 65 degrees ABDC. The most radical timing for this particular valve is therefore valve opens 25 degrees BTDC and valve closes at 65 degrees ABDC for a total opening duration of 270 degrees crank angle. The duration with flappers closed and a valve opening of TDC and valve closing of 10 degrees ABDC is 190 degrees.

The above description although referring to a specific V shaped resilient flapper design shown in FIGS. 1–5 applies as well to other resilient flapper designs, pivotally supported flappers and other flapper configurations in which one or more ends of each flapper is free to move in response to pressure against the flappers. Some embodiments are shown in FIGS. 6 and 7.

FIG. 6 shows a flapper 3 secured to the chamber wall 12 at the leading edge of the valve and its abutting member 22 which defines passage 15 controlled by the flapper. Also shown is a V shaped flapper 9 secured in such a manner that both legs 10 and 11 are free to move to control passage 17 defined by member 8 and chamber wall 13.

FIG. 7 shows pivotally mounted flapper 9 controlling passage 17 defined by chamber wall 13 and member 10 and pivotally mounted flapper 3 controlling passage 15 defined by chamber wall 12 and member 22.

Those skilled in the art will realize that one aspect of my variable timing rotary valve for an internal combustion engine is that the rotating valve body has an arcuate opening which is caused to vary in its arcuate extent in accordance with the difference in the pressure in said cylinder and said intake manifold across the valve opening. This is accomplished by mounting flapper valves or their equivalent adjacent the leading and trailing edges of the arcuate opening of the rotary valve.

It will thus be seen that the objects set forth above among those made apparent from the preceeding description, are efficiently attained and since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

Having described my invention what I claim as new and desire to secure by Letters Patent is:

1. Engine apparatus for obtaining variable intake valve timing in an internal combustion engine comprising at least one cylinder said apparatus comprising:

A. a support member having at least one port communicating with each cylinder and formed with an interior which is at least partially hollow;

B. a rotatable valve member housed within said support member said valve member having means of support for rotation about an axis, and circumferential intake porting means for uncovering said port in said support member for selectively enabling and preventing the flow of intake charge through the valve and its ducting means into the cylinder;

C. means for driving said rotatable valve member at a precise angular speed in relation to crankshaft speed; and, D. means mounted for rotation with said rotatable valve member responsive to the difference in the pressure in said rotatable valve member and said cylinder for changing the effective length of said circumferential intake porting means in said rotatable valve said changing of effective length resulting in changing of the timing and duration of effective communication of said circumferential intake port with said support member port during which intake charge flow is permitted.

2. Engine apparatus for obtaining variable timing of opening, variable opening duration and variable timing of closing in a rotary intake valve for internal combustion engines comprising at least one cylinder said apparatus comprising:

A. a support member having at least one port communicating with each cylinder and formed with an interior which is at least partially hollow;

B. a rotatable valve member housed within said support member said valve member having means of support for rotation about an axis and a circumferential intake port for uncovering said port in said support member for selectively enabling and preventing the flow of intake charge through the valve and its ducting means into the cylinder;

C. means for defining segments of said circumferential intake port adjacent to the leading and trailing edges of said port through which intake charge may flow; and, means for driving said rotatable valve member at a precise angular speed in relation to crankshaft speed D. means mounted for rotation with said rotatable valve member responsive to the difference in the pressure in said rotatable valve member and said cylinder for blocking and unblocking said segments of said circumferential intake port adjacent to the leading and trailing edges of said port thereby changing the timing of registry of the unblocked portion of said circumferential port with said support member port, said changing of timing of registry of said unblocked portion of circumferential port with said support member port changing the timing of valve opening, valve opening duration and valve closing.

3. Apparatus in accordance with claim 1 or 2 wherein said means for blocking and unblocking at least one segment of said circumferential intake port in said rotatable valve comprises at least one pivotally mounted member.

4. Apparatus in accordance with claim 1 or 2 wherein said means for blocking and unblocking at least one segment of said circumferential intake port comprises at least one resilient flapper suitably supported and positioned in the body of said rotatable valve to be movable from an installed and blocking position preventing flow of intake charge through said segment to an unblocking position said position permitting flow of intake charge through said segment.

5. Apparatus in accordance with claim 4 wherein at least one end of said flapper is free to move to block or unblock said segments of said circumferential intake port.

6. Apparatus in accordance with claim 4 wherein said flapper comprises two legs, one leg being secured by appropriate means to said rotatable valve body and the other leg being free to move to block or unblock said segments of said circumferential port.

7. Apparatus in accordance with claim 4 where said flapper comprises at least two legs and both legs move to block or unblock said segments of said circumferential port.

8. In a rotary valve adapted to be located between an intake manifold and a cylinder of an internal combustion engine, said valve having a rotating arcuate valve opening; variable valve timing means mounted for rotation with said rotary valve and responsive to the difference in the pressure in said cylinder and said intake manifold across said valve opening to cause said valve opening to vary an arcuate extent in accordance with said difference in pressure across said valve opening.

9. The rotary valve of claim 8 wherein the arcuate extent of said valve opening increases when said difference in pressure decreases.

10. The rotary valve of claim 8 or 9 wherein said variable valve timing means comprises at least one flapper valve mounted in said rotary valve for rotation therewith.

11. The rotary valve of claim 10 wherein one of said flapper valves is mounted adjacent the trailing edge of said arcuate valve opening.

12. The rotary valve of claim 10 wherein a pair of said flapper valves are mounted adjacent the trailing edge of said arcuate valve opening.

13. The rotary valve of claim 10 wherein one of said flapper valves is mounted adjacent the leading edge of said arcuate valve opening.

14. The rotary valve of claim 13 wherein one of said flapper valves is mounted adjacent the trailing edge of said arcuate valve opening.

15. The rotary valve of claim 13 wherein a pair of said flapper valves are mounted adjacent the trailing edge of said arcuate valve opening.

* * * * *